United States Patent [19]

Wahlquist

[11] Patent Number: 4,516,118

[45] Date of Patent: May 7, 1985

[54] PULSE WIDTH MODULATION CONVERSION CIRCUIT FOR CONTROLLING A COLOR DISPLAY MONITOR

[75] Inventor: Clayton C. Wahlquist, West Valley City, Utah

[73] Assignee: Sperry Corporation, New York, N.Y.

[21] Appl. No.: 412,689

[22] Filed: Aug. 30, 1982

[51] Int. Cl.[3] ..... G09G 1/28

[52] U.S. Cl. ..... 340/703; 340/793; 358/12; 358/283; 315/385

[58] Field of Search ..... 340/703, 701, 793; 358/12, 283, 13; 315/385

[56] References Cited

U.S. PATENT DOCUMENTS

| | | | |
|---|---|---|---|
| 3,294,896 | 12/1966 | Young, Jr. | 358/283 |
| 3,821,796 | 6/1974 | Ernstoff et al. | 340/703 |
| 3,829,613 | 8/1974 | Melchior | 358/12 |
| 3,944,999 | 3/1976 | Moore | 340/703 |
| 4,149,183 | 4/1979 | Pellar et al. | 358/283 |
| 4,149,184 | 4/1979 | Giddings et al. | 340/703 |
| 4,340,889 | 7/1982 | Knight et al. | 340/793 |
| 4,383,256 | 5/1983 | Kurahashi et al. | 340/793 |
| 4,438,453 | 3/1984 | Alston | 358/78 |
| 4,442,428 | 4/1984 | Dean et al. | 340/703 |

*Primary Examiner*—Marshall M. Curtis

*Attorney, Agent, or Firm*—John B. Sowell; Kenneth T. Grace; Marshall M. Truex

[57] ABSTRACT

A video display terminal (VDT) is provided with a controller having six digital logic lines capable of defining sixty-four different colors. An eight color color display monitor (CDM) having three red, green and blue (RGB) video input lines is connected to a pulse width modulation converter capable of converting the sixty-four digital input conditions on the six low level voltage logic lines to sixty-four different color control conditions on the three video input lines.

11 Claims, 14 Drawing Figures

PULSE WIDTH MODULATION CONVERSION CIRCUIT FOR CONTROLLING A COLOR DISPLAY MONITOR

BACKGROUND OF THE INVENTION

1. Field of the Invention

This invention relates to video display terminals and color display monitors used therein. More particularly, this invention relates to a novel conversion circuit for enabling the use of an eight color, color display monitor to display twenty-seven or more different colors.

2. Description of the Prior Art

Video display terminals (VDT) are commercially available with color display monitors which will display twenty-seven distinct colors. The twenty-seven different colors may be employed as either background or foreground colors. Presently, video display terminals (VDT's) are made by a large number of U.S. manufacturers. The color display monitors that are employed in these terminals are only made by a few manufacturers. Heretofore, it has been common practice for the manufacturers of color display monitors to specify the recommended red, green and blue (RGB) input voltage levels which will assure acceptable operation of the color display monitor.

Heretofore, manufacturers of eight-color display monitors (CDM's) specified two low voltage logic levels as input signals for the RGB video input lines. The eight-color CDM's are presently manufactured by several competitive suppliers and have been standardized in this industry. Presently, there are only a few manufacturers of twenty-seven color CDM's, such as Mitsubishi, and the low voltage logic levels of the inputs to the twenty-seven color CDM's have not been standardized. Further, the twenty-seven color CDM's presently available are expensive in comparison to the standard eight-color CDM's. It is believed that a large portion of the extra cost is due to the complexity of the amplifiers and processing circuits at the input of the CDM's of the color cathode ray tube. For example, six lines having two binary logic levels are capable of defining sixty-four distinct conditions. To produce a twenty-seven color CDM, only twenty-seven of the sixty-four possible conditions need to be employed.

Presently, the six lines from the cathode ray tube (CRT) controller are applied to twenty-seven color CDM's which employ amplifying and processing circuits which produce three voltage levels on each of the three RGB video input lines to the color cathode ray tube. Production of three voltage levels on a single line requires rather complex circuitry and employs an analog mode of operation. For example, there is provided in the prior art a high level pulse, a half level pulse and a no level pulse which defines the intensity of the electron beam of the RGB video input lines. The different colors of the prior art twenty-seven color CDM's are produced on the color cathode ray tube screen by applying different intensity signals to the RGB video input lines for the same time duration. It has been observed that the elimination of the requirement for three or more voltage levels to define the intensity of the RGB beams would be highly desirable.

SUMMARY OF THE INVENTION

It has been confirmed by laboratory tests that the same twenty-seven colors produced on the prior art twenty-seven color CDM's may be produced on a color CRT screen by applying identical intensity signals to the RGB video lines of a CRT for different lengths of time. The human eye cannot distinguish that the individual beams from the different color guns are operating for different time durations and the different colors which are visually observed are substantially identical to the prior art twenty-seven colors produced by twenty-seven color CDM's.

It is a principal object of the present invention to provide a conversion circuit for a color display monitor (CDM) of the type adapted to receive two voltage input levels.

It is another principal object of the present invention to provide a six-input and three-output conversion circuit for a twenty-seven color CDM.

It is yet another principal object of the present invention to provide a conversion circuit which permits the operation of a standard eight-color CDM and a twenty-seven color CDM mode of operation.

It is a general object of the present invention to provide a novel pulse width modulation conversion circuit for a CDM.

It is another object of the present invention to provide a reliable and inexpensive pulse width modulation conversion circuit which will convert a standard eight-color CDM to a twenty-seven color CDM.

It is another object of the present invention to provide a novel pulse width modulation conversion circuit which permits the adjustment of the width of the color signal so that the colors on a twenty-seven color CDM may be adjusted.

According to these and other objects of the present invention, there is provided a pulse width modulation conversion circuit which can be connected to the six digital output lines from a CRT controller and will produce on its three-output lines from the conversion circuit digital pulses of the same magnitude which will define twenty-seven different color combinations.

DESCRIPTION OF THE PREFERRED EMBODIMENT

Figure 1:
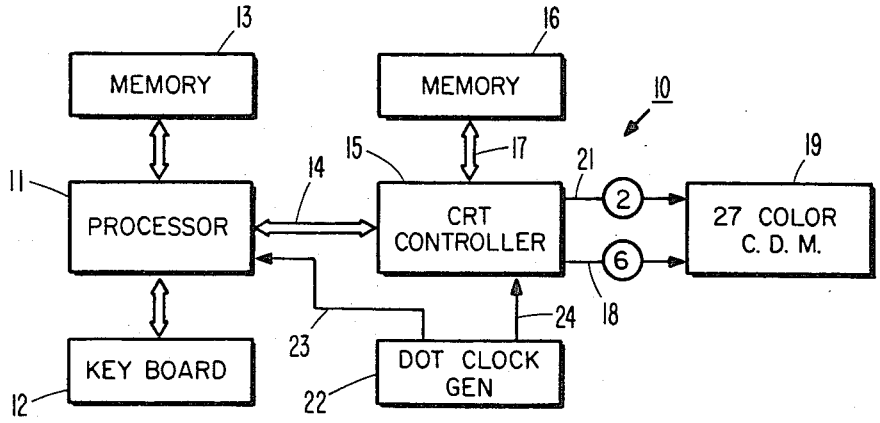
Fig 1 (PRIOR ART)
FIG. 1 is a block diagram showing the main elements of a video display terminal (VDT) having a twenty-seven color display monitor (CDM)

Refer now to FIG. 1 showing a block diagram representative of a video display terminal (VDT) 10. The VDT 10 preferably comprises a processor 11 which has its own keyboard 12 and expandable memory 13. The processor 11 sends commands via bus 14 to the CRT controller 15 which is provided with a memory 16 connected to the controller by bus 17. When the CRT controller 15 has been commanded to produce any alpha/numeric character, the character information is supplied from memory 16 via bus 17 and is presented on output lines 18 to a color display monitor 19 which interprets the signals to produce video drive signals which in turn are applied to the cathode ray tube guns and produce images on the screen. Horizontal and vertical sync signals are provided on line 21 to the color display monitor as is well known in the prior art. A dot clock generator 22 produces the synchronizing dot clock signals which are applied to the processor 11 and the cathode ray tube controller 15 via lines 23 and 24. As will be explained hereinafter, the dot clock generator may also provide additional signals which may be employed.

Figure 2:
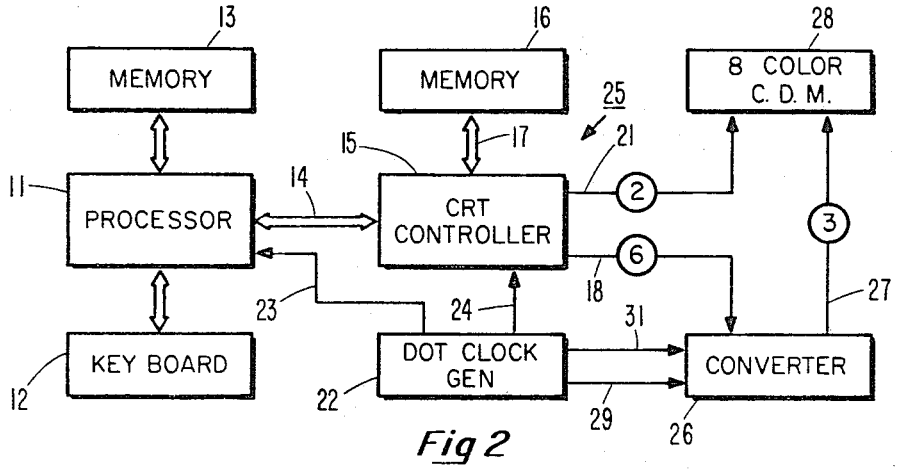
FIG. 2 is a block diagram showing the main elements of the present invention video display terminal (VDT) employing an eight-color display monitor to display the same number of colors as a twenty-seven color display monitor.

Refer now to FIG. 2 which is substantially the same as FIG. 1, thus, the same elements are numbered the same. The video display terminal 25 in FIG. 2 is provided with a novel converter 26 which converts the six output signal lines 18 from the controller 15 to three standardized output signal lines 27 that are applied to an eight-color color display monitor 28. Dot clock generator 22 also supplies to converter 26 via lines 29 and 31 a dot clock signal and a 90° phase shifted dot clock signal. In the preferred embodiment block diagram shown in FIG. 2, the eight color color display monitor 28 can be driven in a mode of operation which will produce all the twenty-seven colors available in the color display monitor 19 shown in FIG. 1. It will be understood that the eight-color color display monitor 28 is both simpler and cheaper than the twenty-seven color display monitor 19.

Figure 3:
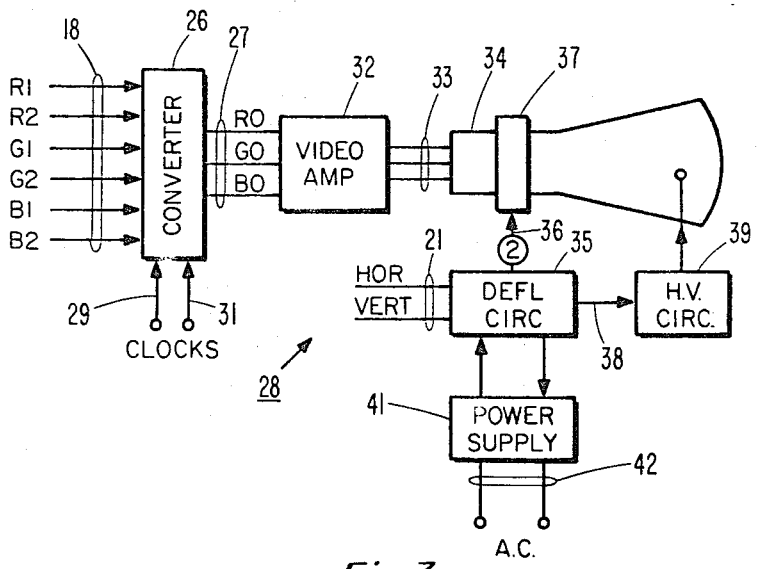
FIG. 3 is a schematic block diagram showing how the six output color control signal lines from the cathode ray tube (CRT) controller can be converted to three RGB video signal lines of an eight-color display monitor.

Refer now to FIG. 3 showing a schematic block diagram of the main elements of a color display monitor and six input lines 18 which define the twenty-seven different colors. For purposes of this explanation, the six input lines 18 are designated R1 and R2 for the two red lines; G1 and G2 for the two green lines and B1 and B2 for the two blue lines. Each of the six lines 18 are provided with two logic levels. The digital signals on lines 18 are applied to the novel converter 26 of the present invention and produce on the three output lines 27, signals which have only two logic levels that will be explained in more detail hereinafter. These signal lines are low voltage logic level signals which are designated R0; G0 and B0 for red, green and blue. The low voltage signals are applied to the video amplifier 32 which is an integral part of the color display monitor 28. The video amplifier processes and amplifies the signals and produces the standard signals for the video drive lines 33 connected to a standard color CRT tube 34. Converter 26 is shown having the aforementioned dot clock signal line 29 and the 90° phase shifted dot clock signal line 31. Also shown in FIG. 3 are the two lines 21 designated horizontal and vertical sync. The sync signal lines 21 are applied to the deflection circuits 35 to produce the deflection signals on lines 36 which are applied to the yoke 37 of the CRT. The deflection circuit 35 also supplies a signal on line 38 to the high voltage circuit 39. The high voltage circuit 39 applies its high voltage signal to the anode of the CRT 34. The power for the color display monitor 28 is provided by power supply 41 and A.C. power lines 42. The video amplifier 32 and the associated circuitry connected to the CRT 34 are inside of the color display monitor 28 and an integral part thereof.

Figure 4:
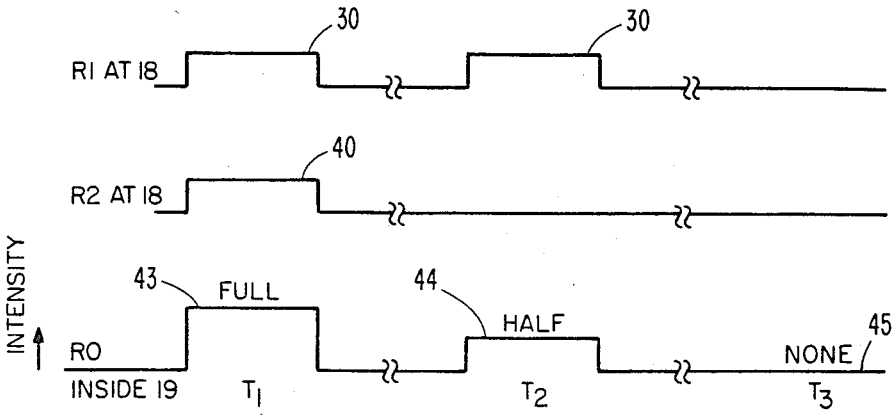
Fig 4 (PRIOR ART)
FIG. 4 is a diagram of input signals and the resulting RGB video signals employed in a prior art twenty-seven color display monitor similar to that shown in FIG. 1.

Before explaining the mode of operation of the novel converter 26, first refer to FIG. 4 which shows the type of analog video input signals applied on lines 18 of the FIG. 1 prior art. The R1 pulses 30 shown occuring at times T1 and T2 are representative of full width pulse signals of the type which would appear on any one of the lines 18 shown in FIGS. 1 to 3. Similarly, the R2 pulse 40 is shown at time T1 having a full width pulse signal as would appear on one of the lines 18. At time T1 both the R1 and R2 pulses are full width and both high, and combine to produce the R0 full voltage height and full width pulse 43. However, at time T2 only the R1 pulse 30 is high and the R2 pulse is low and a half high voltage and full width pulse 44 will be produced at the R0 output. At time T3 neither the R1 or R2 pulses are present and a pulse 45 will be produced which has no amplitude for the full width or full duration of T3 time. It will now be understood that the pulse 43 is twice as high as the pulse 44 and is infinitely higher than the pulse 45. The pulses 43, 44 and 45 are representative of voltage intensity signals that are applied for the full dot generation time duration. These pulses are not applied to the twenty-seven color CDM 19 but are applied to the cathode ray tube inside the twenty-seven color display monitor 19. Since the pulses 43, 44 and 45 have three different levels, they are basically analog signals which are being processed. The prior art converter which produces these analog voltages is not shown or described herein.

Figure 5:
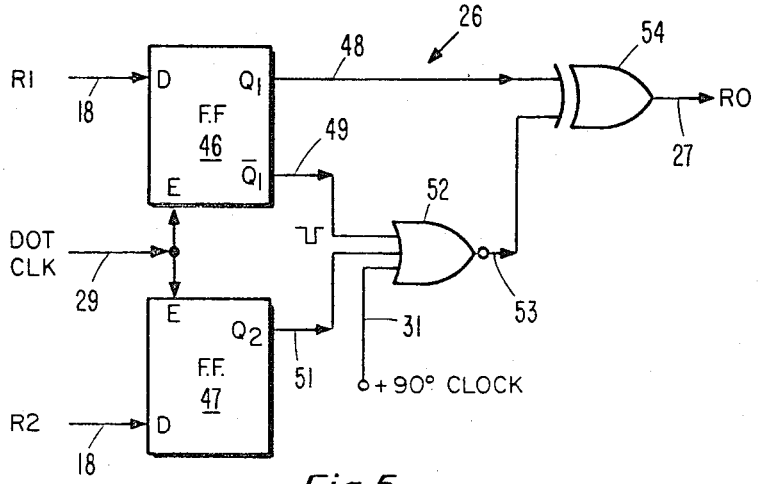
FIG. 5 is a block diagram of a preferred embodiment pulse width modulation conversion circuit which is employed in the converter shown in FIGS. 2 and 3.

Refer now to FIG. 5 showing a block diagram of the preferred embodiment pulse width modulation conversion circuit 26 which can be employed in the FIG. 2 and FIG. 3 embodiments to produce the desirable and novel results explained in detail hereinafter. The R1 input line 18 is applied to a D-type flip-flop 46. The R2 input line 18 is applied to a second D-type flip-flop 47. The aforementioned dot clock signal on line 29 is applied to the enable input of the flip-flops 46 and 47. The Q1 output line 48 from flip-flop 46 goes high when the enable is high and a data signal appears at R1. The signal appearing on line 49 is inverted at the $\overline{Q1}$ output line 49 from flip-flop 46. A signal appears on the Q2 output line 51 from flip-flop 47 when both the enable and R2 input lines to flip-flop 47 are high. The aforementioned delayed and phase shifted clock signal on line 31 is applied to the NOR gate 52 along with the input lines 49 and 51 from flip-flops 46 and 47. When all three inputs are low, the output on line 53 is high. At all other times, the output on line 53 is low. The signals on lines 48 and 53 are applied to the EXCLUSIVE OR gate 54 to produce the aforementioned R0 signal on the line 27 to the video amplifier 32. When the signals on lines 48 and 53 are high, a low signal is produced on R0 line 27. When two low signals are provided to the EXCLUSIVE OR gate 54, a low signal is produced on line 27 and if the input signals on lines 48 and 53 are different, a high signal is produced on R0 line 27. It will be understood that FIG. 5 only shows the conversion circuit for the R1 and R2 lines 18 and that converter 26 also comprises similar converters for the G1 and G2 green lines 18 and the B1 and B2 blue lines 18.

Figure 6:
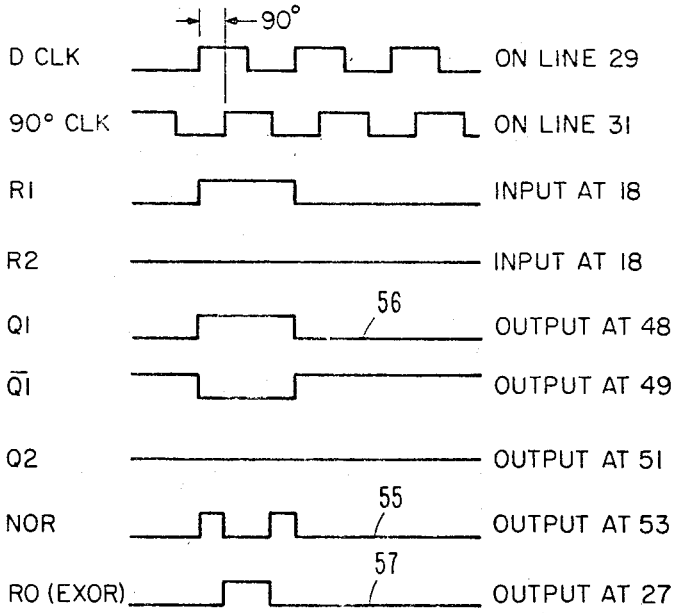
FIG. 6 is a timing and waveform diagram employed to explain the operation of the conversion circuit of FIG. 5.

Refer now to FIG. 6 showing a timing diagram for one of the conversion circuits of FIG. 5. The red conversion circuit 26 for R1 and R2 is explained herein and the blue and green conversion circuits are identical thereto. The dot clock signal on line 29 is shown as being 90° ahead of the 90° delay clock which is on line 31. When the R1 input line 18 is high and the R2 input line 18 is low, a high signal will be produced at the Q1 output line 48 and a low signal will be produced at the $\overline{Q1}$ output line 49. When the signals are applied to the NOR gate 52 along with the delayed clock on line 31 and the Q2 output on line 51 from flip-flop 47, there will be produced the novel waveform signal 55 on output line 53 from NOR gate 52. When the novel output signal 55 is combined in the EXCLUSIVE OR gate 54 with the waveform signal 56 on output line 48, a pulse width modulated signal R0 which is of less time duration than the waveform 56 will be produced on output line 27. It will be understood that the waveform 57 is a digital pulse which is pulse width modulated and is of less time duration than the R1 signal on input line 18 and the output signal from flip-flop 46 on line 48. The R0 signal 57 which appears on the R0 line 27 may be applied directly to the amplifier 32 inside an eight color color display monitor 28 as shown in FIG. 2 without modification. Similarly, the G0 and B0 signals which are not shown may be applied to the video drive line 27 of the eight color color display monitor 28 of FIG. 2. Another feature of the conversion circuit of FIG. 5 is that the D-type flip-flops 46 and 47 are usually already available in the CRT controller 15 shown in FIG. 2. Further, the NOR gate 52 and EXCLUSIVE OR gate 54 are usually available on some of the integrated circuits that are already present in controller 15. Thus, it will be understood that the minimum circuitry shown in FIG. 5 often is available at a minimal cost and constitutes an extremely reliable and effective circuit for accomplishing the converter 26.

Figure 7:
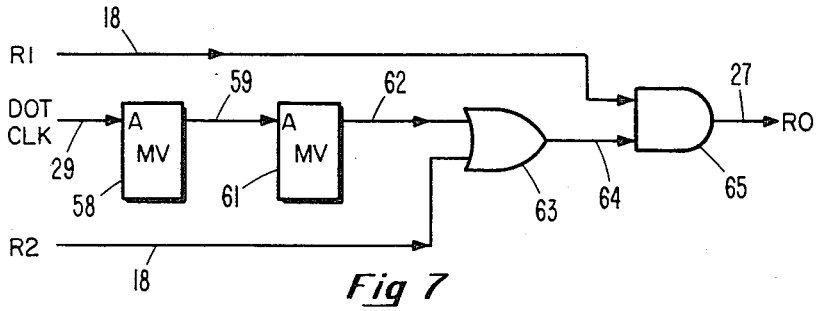
FIG. 7 is a block diagram of another preferred embodiment pulse width modulation conversion circuit employed in the converter shown in FIGS. 2 and 3.

Refer now to FIG. 7 which is a block diagram of another preferred embodiment pulse width modulation converter which can be embodied into the converter 26. The aforementioned dot clock signal on line 29 is shown being applied to a one shot multivibrator 58. This multivibrator effectively delays the dot clock signal and produces a delayed signal on line 59 which is applied to the adjustable one shot multivibrator 61 which is employed to adjust the width of the pulse which is produced on line 62 and applied to OR gate 63. The aforementioned R2 line 18 is connected to the OR gate 63 and the output on line 64 is applied to an AND gate 65 along with the R1 input from line 18 to produce an adjustable width R0 pulse output on output line 27.

Figure 8:
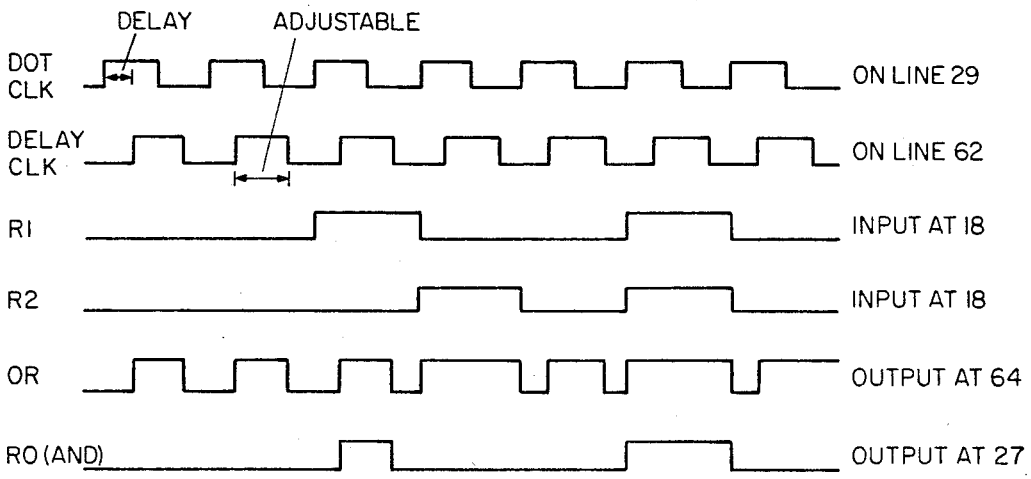
FIG. 8 is a timing and waveform diagram employed to explain the operation of the converter of FIG. 7.

Refer now to FIG. 8 showing the timing diagram waveforms associated with the conversion circuit of FIG. 7. The dot clock is produced on line 29 and applied to multivibrators 58 and 61 to produce the delayed and adjustable dot clock signal on line 62. The output from OR gate 63 is produced on line 64 and is gated in AND gate 65 together with the R1 input on line 18 to produce the desired pulse width modulated output on line 27 shown as the R0 signal which may be applied directly via line 27 to the eight-color color display monitor 28 as shown in FIG. 2. It will be understood that the green and blue conversion circuits, similar to the red conversion circuit shown in FIG. 7, will also be applied via lines 27 to the eight-color color display monitor 28 shown in FIG. 2 to produce the desired twenty-seven color color display monitor results. Having explained the operation of the conversion circuit shown in FIG. 7, it will now be understood that its advantage is that the width of the R0 pulse produced on the R0 output line 27 may be adjusted so as to produce any desired tint of color.

Figure 9:
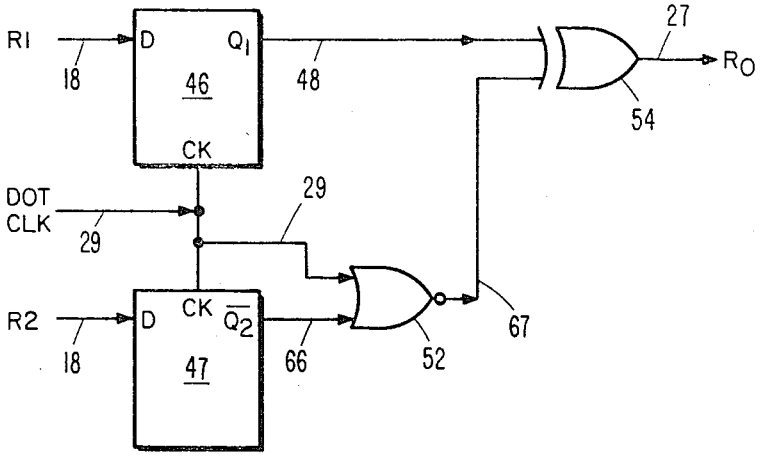
FIG. 9 is a block diagram of a modified embodiment pulse width modulation conversion circuit which may be employed in the converter shown in FIGS. 2 and 3.

Refer now to FIG. 9 which is a modified embodiment of the conversion circuit shown in FIG. 5. The same elements employed in the FIG. 5 converter may be employed in the FIG. 9 converter. The difference resides in the fact that the $\overline{Q2}$ output from flip-flop 47 on line 66 is applied to the NOR gate 52 which is a two-input NOR gate rather than a three-input NOR gate and produces a different signal on line 67 which is applied to the EXCLUSIVE OR gate 54 along with the Q1 signal from flip-flop 46 on line 48 to produce the desired R0 output signal on line 27. This R0 signal on line 27 is also applied to the eight-color color display monitor 28 via line 27 as shown in FIG. 2 as was explained with regard to the conversion circuit of FIG. 5.

Figure 10:
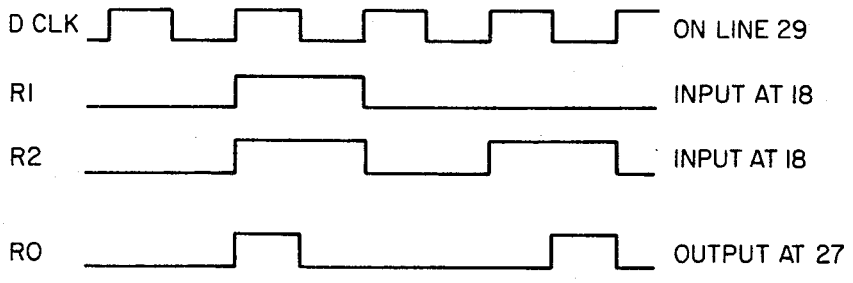
FIG. 10 is a timing and waveform diagram employed to explain the operation of the converter of FIG. 9.

Refer now to FIG. 10 showing in simplified form the timing diagrams associated with the modified conversion circuit of FIG. 9. The dot clock on line 29 is identical to the aforementioned dot clock and the R1 and R2 signals at the input lines 18 are also identical. It will be noted that the pulse width modulated result signal appearing as the R0 signal on line 27 is pulse width modulated either at the beginning of the rise time of the R2 signal or at the end of the R2 signal as may be the case depending on R1 and R2 both being high or R2 being high when the R1 is low.

Figure 11:
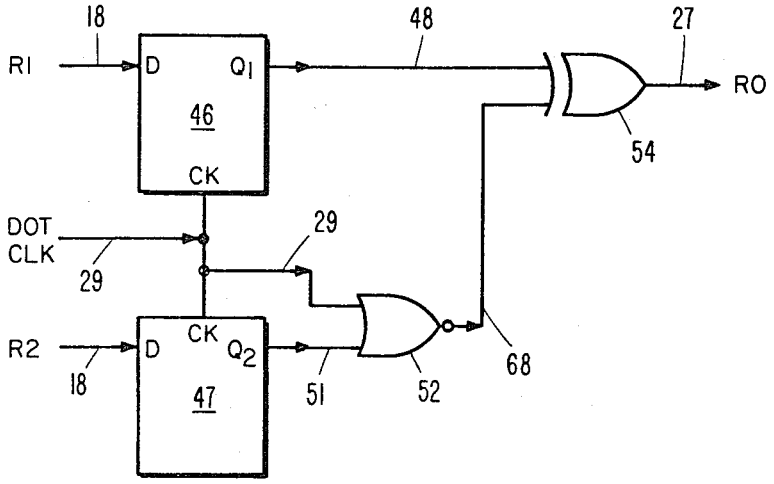
FIG. 11 is a block diagram of a modified embodiment pulse width modulation conversion circuit which may be employed in the converter shown in FIGS. 2 and 3.

Refer now to FIG. 11 which is another modified embodiment of the conversion circuit shown in FIG. 5. Again, the elements of the conversion circuit in FIG. 11 are the same as the elements of the conversion circuit in FIG. 5 and are numbered the same. The R1 and R2 signals on line 18 are applied to the flip-flops 46 and 47 to produce the same signals as produced with regard to the FIG. 5 conversion circuit on lines 48 and 51. The dot clock signal on line 29 is applied directly to the NOR gate 52 along with the Q2 output on line 51 to produce the new output signal on line 68 which is applied to the EXCLUSIVE OR gate 54 along with the signal on line 48 to produce the desired output signal on line 27.

Figure 12:
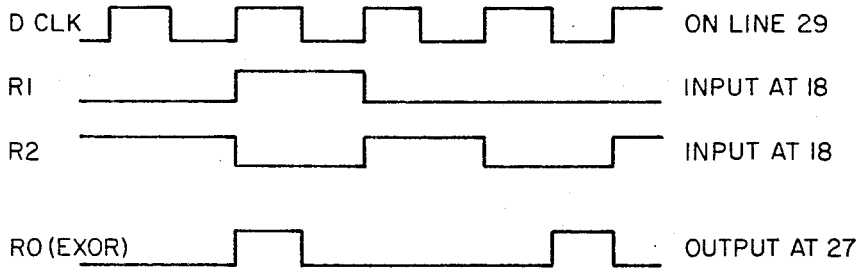
FIG. 12 is a timing and waveform diagram employed to explain the operation of the converter of FIG. 11.

Refer now to FIG. 12 showing the timing diagram waveforms associated with the FIG. 11 converter. The dot clock signal on line 29 and the R1 and R2 input signals on line 18 are shown in their respective high and low signal states. These signals, when combined, produce the desired pulse width modulated signal on line 27 shown as the R0 signal which appears at the leading edge of R2 in one instance, and at the trailing edge of R2 in the second instance depending on whether R1 is high or low.

Figure 13:
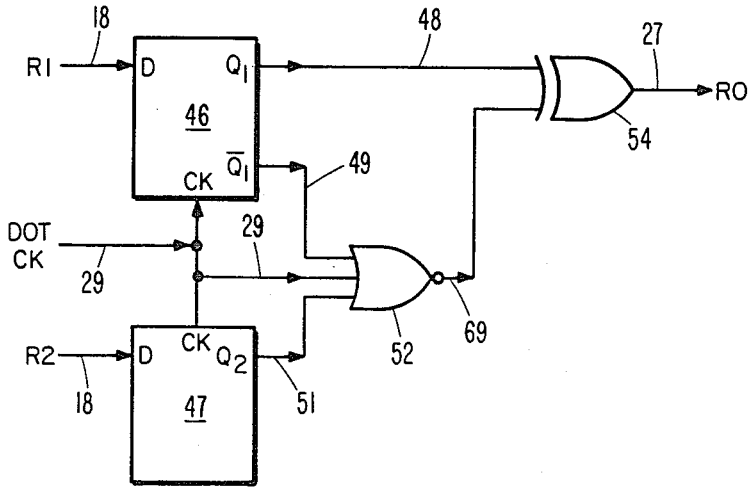
FIG. 13 is a block diagram of another modified embodiment pulse width modulation conversion circuit which may be employed in the converter shown in FIGS. 2 and 3.

Refer now to FIG. 13 which is a block diagram of yet another modified embodiment of the FIG. 5 converter. The R1 and R2 inputs on line 18 are applied to the flip-flops 46 and 47 to produce output signals on lines 49 and 51 which are applied to the three-input NOR gate 52. The third input to NOR gate 52 is the dot clock signal from line 29 which produces a new novel signal on line 69 which is applied as an input to the EXCLUSIVE OR gate 54 along with the signal on line 48. The output from EXCLUSIVE OR gate 54 on line 27 is the desired R0 signal.

Figure 14:
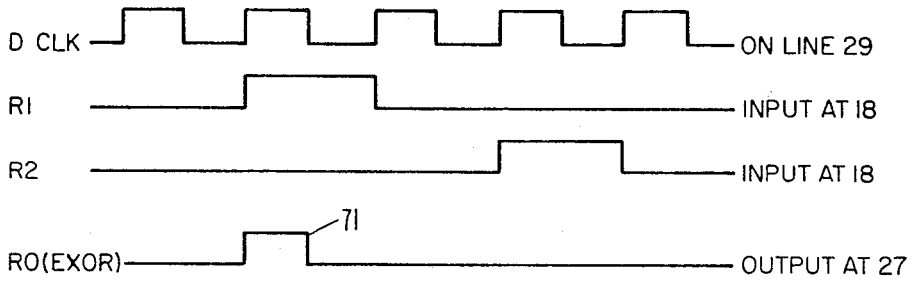
FIG. 14 is a timing and waveform diagram employed to explain the operation of the converter of FIG. 13.

Refer now to FIG. 14 showing the timing diagram for the modified converter shown in FIG. 13. The dot clock signal on line 29 and the R1 and R2 inputs on line 18 are shown being processed in gates 52 and 54 to produce the novel pulse width modulated signal on line 27 which is the R0 signal which may be applied as one of the three inputs to the eight color color display monitor 28 shown in FIG. 2. It will be understood that in one instance when R1 is high and R2 is low, the pulse width modulated signal 71 will be produced but in the other instance signal 71 will not be produced when R2 is high and R1 is low. Accordingly, the converter shown in FIG. 13 may not be as desirable as the aforementioned preferred embodiment conversion circuit shown in FIG. 5. However, since only three conditions are needed in order to employ the eight-color color monitor 28 in a twenty-seven color mode, this converter can be as operational as any of the aforementioned circuits.

Having explained two preferred embodiment conversion circuits and three modified conversion circuits, it is now apparent that other preferred embodiment pulse width modulation conversion circuits may be made by making minor modifications to the conversions circuits shown in the present specification. In those instances when the width of the modulated signal needs to be adjustable so as to obtain very fine adjustment of the tint of the color achieved, an adjustable pulse conversion circuit of the type explained with regards to FIG. 7 may be employed. When the simple elements that are usually available at minimal cost in the video display terminal are employed, an inexpensive and reliable conversion circuit may be obtained. Other forms of pulse width modulation and more complex circuits may be employed to achieve the same or substantially the same results. For example, the six lines at the output of CRT controller 15 shown in FIG. 2 are capable of identifying sixty-four separate digital conditions. These sixty-four conditions on the six lines 18 may be applied to a converter similar to the converter 26 to produce sixty-four colors which also could be applied to an eight color CDM 28 of the type shown and explained with regards to FIG. 2. In order to accomplish this result, it is only necessary to modify the aforementioned converter circuits so that the pulse width modulation signal produced on line 27 has four separate and distinct pulse widths. For example, a full pulse width of full intensity, a full pulse width of no intensity, a partial width pulse of full intensity and a second and different partial width pulse of full intensity would enable the converter to produce sixty-four distinct colors on the three-input lines 27 which are applied to the eight-color, color display monitor 28.

Having explained how the converter 26 can be expanded to produce sixty-four distinct colors from six input lines those skilled in the art will understand that the CRT controller 15 is capable of specifying on more than six lines, more than sixty-four colors which can be converted in a converter of the type explained herein with regards to converter 26 so as to produce as many different pulse width modulation signals as desired to produce any number of desired colors for input into an eight-color color display monitor 28.

I claim:

1. A conversion circuit for a video display terminal having twenty-seven selectable colors comprising:

an eight-color CDM of the type having only three RGB video input lines, a cathode ray tube controller of the type having six output color control signal lines capable of defining sixty-four logic states, each signal line having two logic states being defined by full width pulses or the absence of full width pulses, said six output color control signal lines providing three RGB color pairs of output color control lines, three pulse width modulation conversion circuits each having one of said three RGB color pairs of output control lines coupled to its input, each said pulse width modulation conversion circuit having its output coupled to one of said three RGB video input lines of said eight-color CDM, each output control line of said pulse width modulation conversion circuit having at least three possible pulse width modulation conditions in response to the two logic states on said control signal lines, said logic states being full width pulses and the absence of full width pulses and said pulse width modulation conditions being partial width pulses, full width pulses and the absence of pulses, and a dot clock generator coupled to said three pulse width modulation conversion circuits and to said cathode ray tube controller for synchronizing said pulses, whereby said eight-color CDM is converted to display as many colors as a twenty-seven color CDM.

2. A conversion circuit as set forth in claim 1 wherein each said pulse width modulation conversion circuit comprises;

a pair of input registers, each of said registers being connected to one of said six output color control lines from said cathode ray tube controller.

3. A conversion circuit as set forth in claim 2 wherein each said pulse width modulation conversion circuit further comprises;

an EXCLUSIVE OR gate coupled to the output of said registers.

4. A conversion circuit as set forth in claim 3 wherein each said pulse width modulation conversion circuit further comprises;

a NOR gate having an input coupled to one of said registers and an output C coupled to said EXCLUSIVE OR gate.

5. A conversion circuit as set forth in claim 4 wherein said NOR gate is provided with an input coupled to each of said registers.

6. A conversion circuit as set forth in claim 5 wherein said NOR gate is further provided with a phase delayed clock pulse input.

7. A conversion circuit as set forth in claim 6 wherein each said register comprises a flip-flop having an enable input terminal connected to a second clock pulse input and a data input terminal connected to one of said six output color control lines from said cathode ray tube controller.

8. A conversion circuit as set forth in claim 7 wherein said phase delayed clock pulse input and said second clock pulse input are phase shifted by approximately 90°.

9. A conversion circuit as set forth in claim 7 wherein said clock pulses have a time duration less than the time duration of the dot color signal being presented on said six output color control lines from said cathode ray tube controller.

10. A conversion circuit as set forth in claim 1 wherein each said pulse width modulation conversion circuit comprises a pair of multivibrators connected in series for generating phase delayed clock signals.

11. A conversion circuit as set forth in claim 10 wherein one of said multivibrators is an adjustable one-shot multivibrator for generating different width phase delayed clock signals.

* * * * *